US009212655B2

(12) United States Patent
Neumair

(10) Patent No.: US 9,212,655 B2
(45) Date of Patent: Dec. 15, 2015

(54) PUMP AGGREGATE

(71) Applicant: HAWE HYDRAULIK SE, Munich (DE)

(72) Inventor: Georg Neumair, Thalhausen (DE)

(73) Assignee: HAWE Hydraulik SE (DE)

( * ) Notice: Subject to any disclaimer, the term of this patent is extended or adjusted under 35 U.S.C. 154(b) by 251 days.

(21) Appl. No.: 13/839,122

(22) Filed: Mar. 15, 2013

(65) Prior Publication Data

US 2013/0251558 A1 Sep. 26, 2013

(30) Foreign Application Priority Data

Mar. 21, 2012 (EP) ..... 12160580

(51) Int. Cl.
*F04B 1/08* (2006.01)
*F04B 17/03* (2006.01)
*F04B 17/06* (2006.01)

(52) U.S. Cl.
CPC . *F04B 1/08* (2013.01); *F04B 17/03* (2013.01); *F04B 17/06* (2013.01)

(58) Field of Classification Search
CPC ..... F04B 1/04; F04B 1/08; F04B 17/03; F04B 1/06; F15B 2211/20592; F01B 1/0413
USPC ..... 417/247, 248, 254, 271, 273, 307, 308, 417/415, 62
See application file for complete search history.

(56) References Cited

U.S. PATENT DOCUMENTS 2,578,146 A * 12/1951 Newton ..... 417/238
4,651,380 A 3/1987 Ogden
6,739,129 B2 * 5/2004 Heusser et al. ..... 60/468
7,448,858 B2 11/2008 Neumair et al.
2001/0028850 A1 * 10/2001 Neumair ..... 417/199.1
(Continued)

FOREIGN PATENT DOCUMENTS

EP 1731762 A1 12/2006
EP 2241753 A1 10/2010
(Continued)

OTHER PUBLICATIONS

Extended European Search Report Dated Dec. 6, 2012, Application No. 12160580.2-2315, Applicant Hawe Hydraulik SE, 4 Pages.

*Primary Examiner* — Charles Freay
*Assistant Examiner* — Kenneth J Hansen
(74) *Attorney, Agent, or Firm* — Brooks Kushman P.C.

(57) ABSTRACT

A pump aggregate (A) comprises a housing (1, 2, 4), a high-pressure pump (5) and a low-pressure pump (6) disposed in the housing, an oil-immersed electric motor (7), a return connection point (8) connected to a return line (9), and a valve arrangement (V) mounted between separated discharge outlet ports of both pumps (5, 6) and a pressure connection point (P). The valve arrangement (V) comprises at least a low-pressure change-over valve (U), a check valve (R) for combining discharge flows of both pumps (5, 6), and a system pressure-limiting valve (DB). At least the low-pressure change-over valve (U) and the check valve (R) are arranged in an interior of the housing (1, 2, 4) and are connected so that the discharge flows of both pumps (5, 6) are combined in the housing interior for a single pressure outlet (13, P') of the housing, and wherein the system pressure-limiting valve (DB) is connected to the pressure outlet and is mounted on an exterior of the housing.

20 Claims, 8 Drawing Sheets

(56) References Cited

U.S. PATENT DOCUMENTS

2006/0255657 A1 11/2006 de Ojeda et al.
2007/0286740 A1* 12/2007 Dehlke et al. ..... 417/53

FOREIGN PATENT DOCUMENTS

EP 2330304 A1 6/2011
WO 2008055147 A2 5/2008

* cited by examiner

FIG. 9
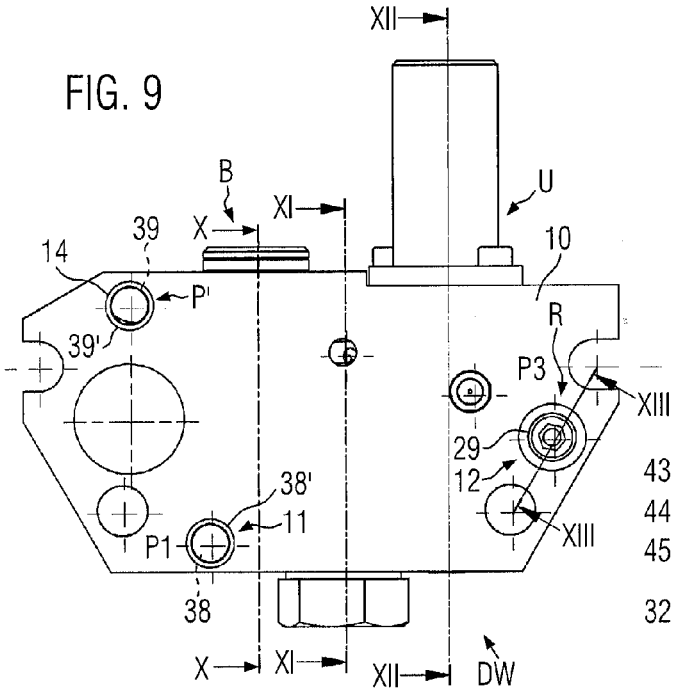
FIG. 13
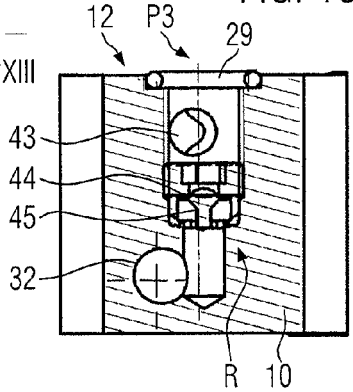
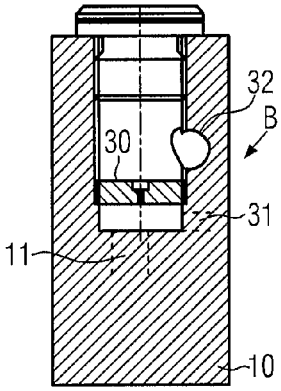
FIG. 10
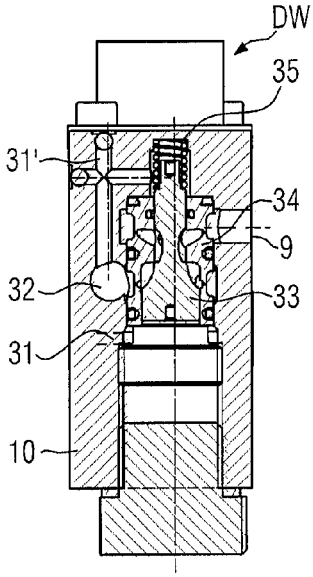
FIG. 11
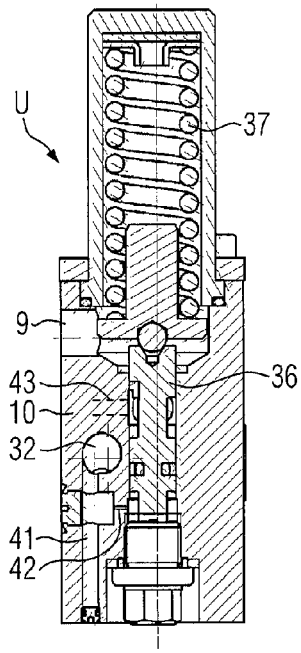
FIG. 12

PUMP AGGREGATE

CROSS-REFERENCE TO RELATED APPLICATIONS

This application claims foreign priority benefits under 35 U.S.C. §119(a)-(d) to European patent application number EP 12 160 580.2, filed Mar. 21, 2012, which is incorporated by reference in its entirety.

TECHNICAL FIELD

The present disclosure relates to a pump aggregate.

BACKGROUND

Such a pump aggregate A (FIGS. 1 and 2) is manufactured and distributed by the applicant and is used for installation, for example, in portable tool assemblies, e.g., torque screwdrivers for generating high tightening torques. Such tool assemblies are used in the assembly of wind turbines, whereby in one model with a single-phase alternating current oil-immersed motor 7 that does not start up against pressure, a pressure shunting switch DW is contained in a valve combination V on the exterior of the housing. The pressure shunting switch can be dispensed with in aggregate models (not shown) containing a three-phase alternating current oil-immersed motor that does start up against pressure. The housing, which is frequently installed in a recumbent operating position, consists of an externally ribbed pipe section 1, housing covers 2, 4 mounted thereupon, and an optionally provided cooling fan 3 on one housing cover 2. The housing has (FIG. 2) two separated pressure outlets (pressures P1 and P3 of the pumps 5, 6) for the discharge flows discharged outwards, to which two connection ports of the valve combination are connected. In the valve combination are contained a pressure line to a pressure outlet (pressure P) of the valve combination, a return line 9 to a return connection point 8 of the housing and at least one pilot line extending to the closing control side of the pressure shunting switch DW, all formed as channels penetrating a plurality of blocks. In addition to a system pressure-limiting valve DB, the valve combination V contains a low-pressure change-over valve U to the return line 9, a check valve R, optionally the pressure shunting switch DW with an assigned aperture B and optionally a secondary pressure-limiting valve SD. At least one directional control valve W is arranged on the block group of the valve combination V. From this layout, a relatively large weight results for a particular performance specification of the pump aggregate, which fundamentally, and especially for the portable tool assembly into which the pump aggregate is to be installed, represents a considerable disadvantage. Furthermore unfavourable is the relatively high and expansive dimension of the valve combination and the directional control valve on the housing exterior that, due to vibrations caused by operation, leads to significant local stress for the housing at those locations of the two pressure outlets at which the valve combination is mounted to the housing exterior wall.

A similar pump aggregate with a dual-circuit pump system is known from EP 2 330 304 A. Here again, the valve combination is mounted on the exterior of the housing.

Further state of the art is contained in EP 2 241 753 A and EP 1 731 762 A.

SUMMARY

The disclosure is based on the object of creating a pump aggregate of the type mentioned at the beginning having reduced weight for a given performance specification.

By means of the incorporation of at least the low-pressure change-over valve and the check valve into the housing interior, so-to-say under oil, in a more compact arrangement with shorter flow paths and simple mounting possibilities, as well as by means of a reduced oil content volume in the housing as a consequence of the internally incorporated components, the pump assembly is significantly lighter and the exteriorly mounted components are less expansive. Because the feed discharge flows of the pumps are already combined in the housing interior only a single pressure outlet is needed at the housing, this restructuring also contributes to weight savings compared to the known construction method. Furthermore, one external sealing area is saved. The weight savings can be further increased if a smaller oil-immersed motor with a high or increased power density is deployed. In the case of a pump aggregate with a single-phase alternating current oil-immersed motor and a pressure shunting switch, it is possible in this way to save more than one-third of the weight when compared to known pump aggregates with the same performance specification.

In the case of an expedient embodiment of the pump aggregate containing an alternating current oil-immersed motor that does not start up reliably against pressure, the pressure shunting switch is installed to the return line, however with an associated aperture, together with the low-pressure change-over valve and the check valve in the housing interior and in a very compact overall arrangement in the housing, as a result of which further weight is saved. If a three-phase oil-immersed motor is deployed instead of an alternating current oil-immersed motor, optionally the constructional requirements for the incorporation of the pressure shunting switch and its aperture can be kept, without however providing the pressure shunting switch and the aperture. The flow channels provided for their functions can be closed with plugs.

Expediently, the low-pressure change-over valve, the check valve, and optionally the pressure shunting switch with its aperture are arranged in a shared, very compact valve block that is mounted in the interior of the housing on pump elements of the two pumps: The pump elements are installed on an housing interior wall structure. In this way, these equipment components are grouped most compactly, as a result of which noticeable weight savings result and only a small oil volume is occupied.

Expediently, the valve block, which accommodates the equipment components in the housing interior, has only a single outlet which is connected through the housing interior wall structure to the pressure outlet of the housing. This contributes indirectly to the weight savings because housing channels are shortened and some are eliminated and only a single exterior sealing area is required.

The valve block expediently has an approximately trapezoidal profile which can be nestled in a space-saving manner into an approximately circular interior cross-section of the housing. This valve block can be formed in an extraordinarily compact manner, and contains in the most compact area all the valve components incorporated in the interior of the housing.

In an expedient embodiment, a plurality of high-pressure and low-pressure pump elements of the two pumps are installed around a drive shaft of the oil-immersed motor alternatingly in circumferential direction and essentially in the same radial plane of the housing on the housing interior wall structure. In order to achieve a high degree of uniformity while discharging, three high-pressure pump elements and three low-pressure pump elements are expedient, each of which is connected to the others via a high-pressure or low-pressure, respectively, pressure collector ring, which combines the respective discharge flows. This concept is favourable for the assembly of the valve block which, preferably, is mounted on collector plates of the low-pressure pressure collector ring, which collector plates consequently also take over the additional task for the placement of the valve block. This construction method particularly saves significant mounting space in the direction of the drive shaft axis.

With a view to a compact construction in spite of the incorporation of the equipment components in the interior of the housing, it is expedient if the high-pressure pressure collector ring has a body mounted underneath one high-pressure pump element, the body comprising a connection protrusion through which the outlet port of the valve block is connected to the pressure outlet of the housing. This is preferably done by means of a pressure pipe press-fitted into the connection protrusion of the body and into a bore formed in the housing interior wall structure. In this way, the single outlet port of the valve block is connected to the pressure outlet of the housing in a short flow path.

The pump aggregate can be conceived for an upright or a recumbent operating position, in that depending on the selected operating position, suction hoses mounted to at least some of the high-pressure and/or low-pressure pump elements extend to an aggregate oil sump provided at a low position in the housing interior (low depending on the position during use). Such a pump aggregate will usually be installed in a recumbent operating position, especially in portable tool assemblies.

Recommended for the pump aggregate is a design in which the housing has an externally ribbed pipe section with the internally moulded-in housing interior wall structure, both for fixing in place the oil-immersed motor and for the assembly of the pumps, e.g., a light metal cast body that is closed on both ends by affixed housing covers. For permanent operation of the pump aggregate or for thermal relief of the oil stored in the housing, it can be expedient if one housing cover bears a cooling fan, for example, an electric cooling fan.

Expediently, external parts of the valve combination and the directional control valve are mounted on the housing exterior wall above the single pressure outlet of the housing, particularly the system pressure-limiting valve, and a secondary pressure-limiting valve, with the directional control valve affixed either to the system pressure-limiting valve or to the secondary pressure-limiting valve.

A weight-saving design results if the aperture, the check valve, the low-pressure change-over valve and the optionally provided pressure shunting switch each have valve inserts inserted into valve block bores connected by channels formed within the valve block. This is advantageous in terms of the assembly and additionally saves costs, because highly loaded or specially processed or tempered valve inserts made of high-grade steel or tool steel are accommodated in the valve block bores of the valve block which is manufactured from simple steel.

A compact accommodation of the internally incorporated components of the valve combination is possible if a connection port of the valve block is connected to an outlet port of the high-pressure pressure collector ring and if the single outlet port of the valve block is connected to an inlet port of the body of the high-pressure pressure collector ring, respectively via an inserted pressure pipe, and if the valve block is mounted in sealed fashion with an inlet port, to the check valve directly above an outlet port, preferably in a collector plate, of the low-pressure pressure collector ring. In this way, the valve block only needs a minimum material volume, because the connection port, the outlet port and the inlet port can be positioned directly in at least one exterior side of the valve block.

Exemplary embodiments of the object of the disclosure are explained in more detail with reference to the below drawings.

BRIEF DESCRIPTION OF THE DRAWINGS

FIG. 9 is a valve block shown already mounted in FIG. 8 and here detached, with incorporated equipment components, in a side-view and on a larger scale;

FIG. 10 is a sectional view of the valve block in plane X-X in FIG. 9;

FIG. 11 is a sectional view of the valve block in plane XI-XI in FIG. 9;

FIG. 12 is a sectional view of the valve block in plane XII-XII in FIG. 9;

FIG. 13 is a sectional view of the valve block in plane XIII-XIII in FIG. 9;

DETAILED DESCRIPTION

As required, detailed embodiments are disclosed herein. However, it is to be understood that the disclosed embodiments are merely exemplary and that various and alternative forms may be employed. The figures are not necessarily to scale. Some features may be exaggerated or minimized to show details of particular components. Therefore, specific structural and functional details disclosed herein are not to be interpreted as limiting, but merely as a representative basis for teaching one skilled in the art.

Figure 1:
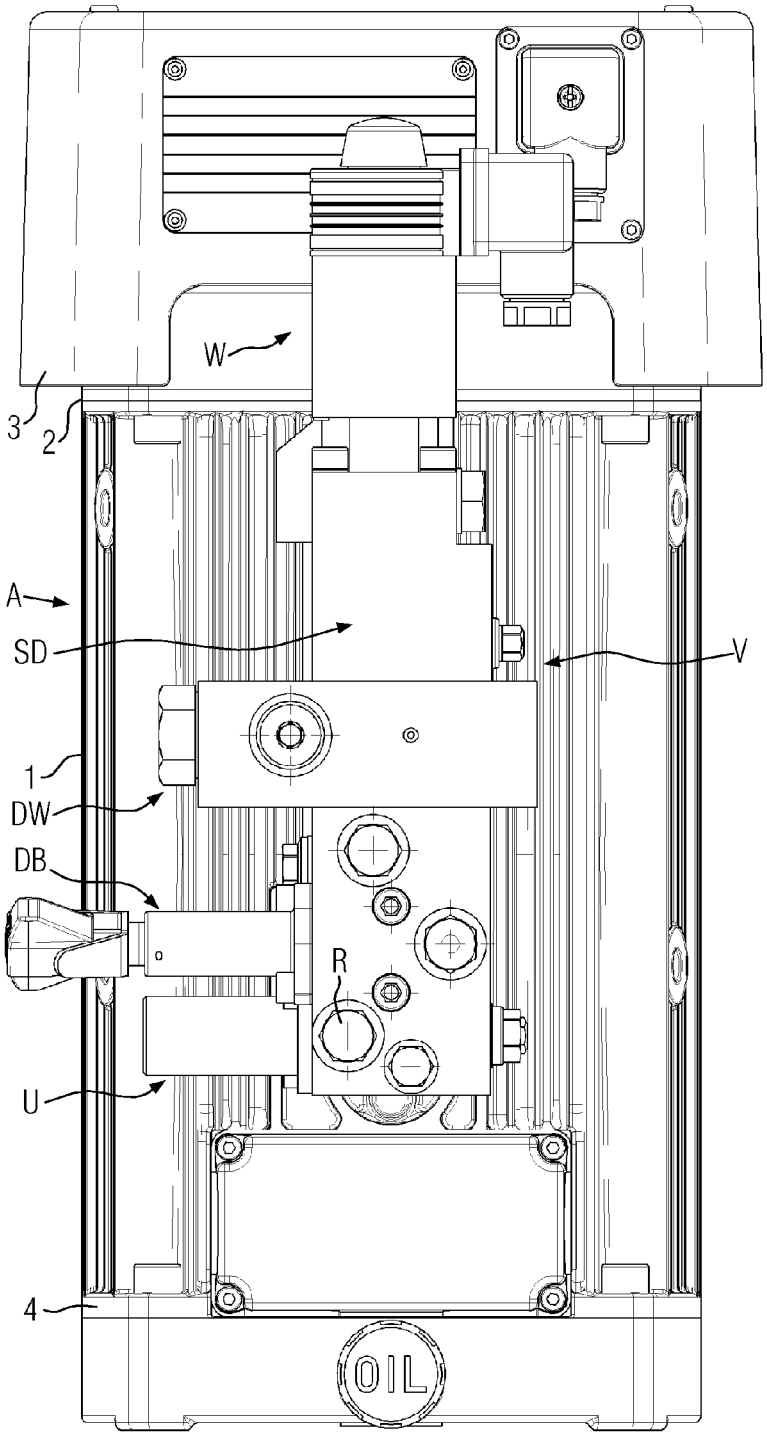
FIG. 1 PRIOR ART
FIGS. 1 and 2 are a side view and an accompanying block diagram, respectively, of a prior art pump aggregate.
Figure 2:
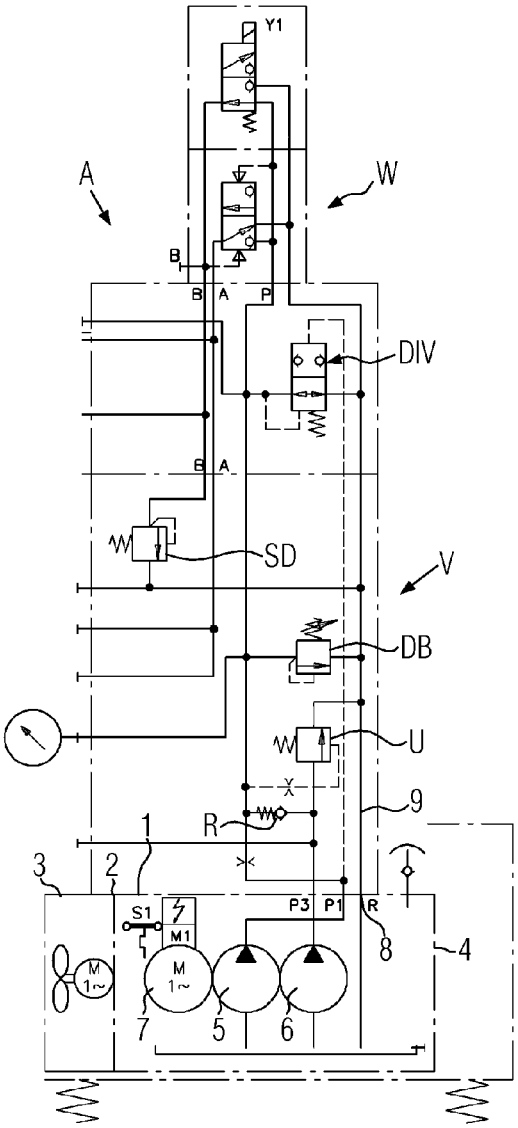
FIG. 2 PRIOR ART

With regard to the reference numbers used for equipment components in the explanation of the prior art in FIGS. 1 and 2, equipment components with the same functions and reference numbers also appear in FIGS. 3 to 15 showing embodiments of the pump assembly or aggregate A of the disclosure.

Figure 3:
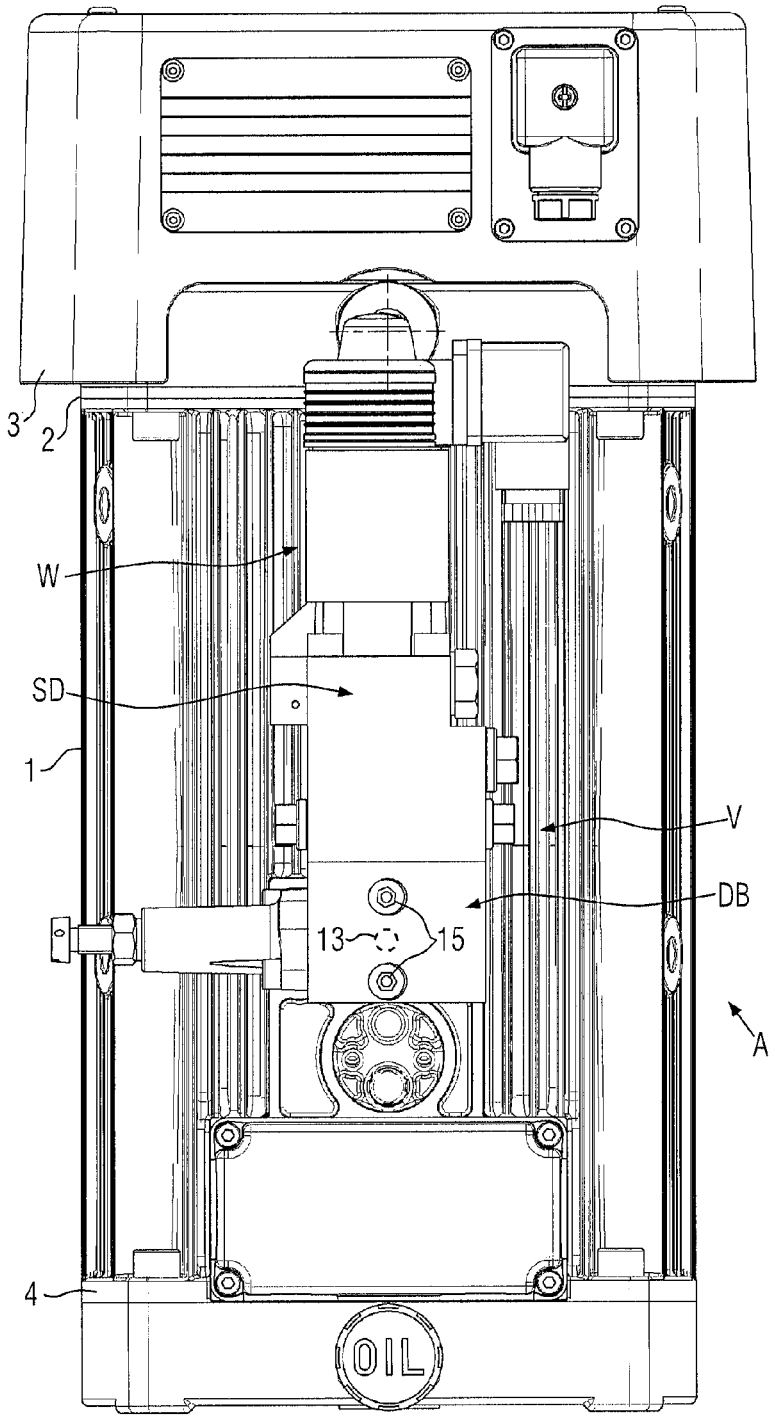
FIG. 3 is a side view of a pump aggregate according to the present disclosure.

The comparison of FIGS. 1 and 3 already shows that the housing 1, 2, 3, 4 of the pump aggregate A according to an embodiment of the present disclosure for the given performance specification has the same exterior dimensions as the known pump assembly A in FIG. 1. However, in the known pump aggregate A in FIG. 1, the external valve combination V comprises the low-pressure change-over valve U, the check valve R, the system pressure-limiting valve DB, the pressure shunting switch DW with assigned aperture B and the optional secondary pressure-limiting valve SD. The pump aggregate A according to an embodiment of the present disclosure now comprises externally in the valve combination V only the system pressure-limiting valve DB, the optionally provided secondary pressure-limiting valve SD and the at least one directional control valve, all mounted externally with mounting screws 15 above a single pressure outlet 13 of the housing.

The housing comprises the pipe section 1, the housing covers 2, 4 and optionally the, for example, electric, cooling fan 3. The pipe section 1 can be a light metal or light metal alloy cast part. The valve combination V equipment components which are no longer mounted externally in FIG. 3 are, as is apparent, for example, from FIGS. 8, 6 and 9, accommodated in the housing interior, as is also apparent from the block diagram of the pump aggregate A according to the disclosure in FIG. 4.

Figure 4:
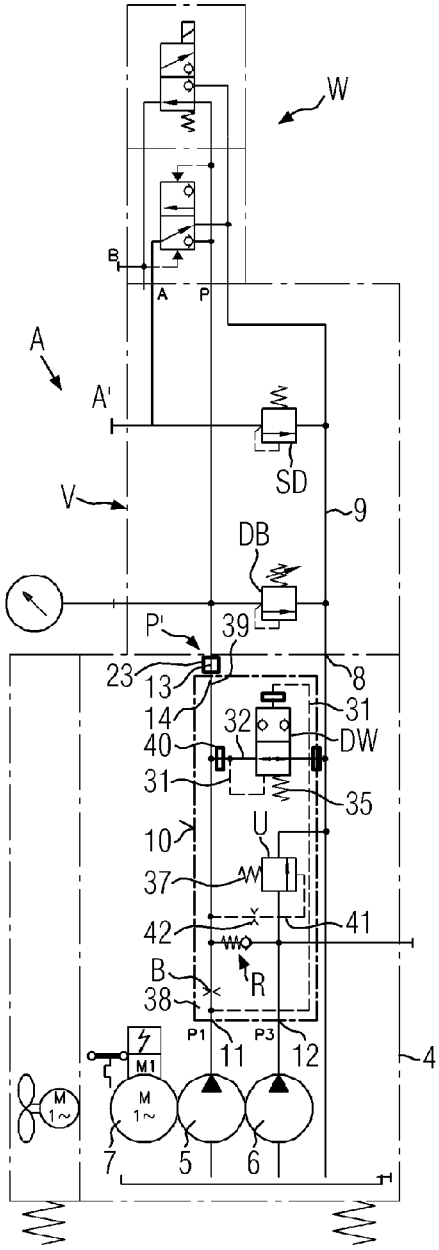
FIG. 4 is a block diagram of the pump aggregate shown in FIG. 3.

The scale of the pump aggregate A in FIG. 4 differs from that of the prior art pump aggregate A in FIG. 2, but it also contains, in a housing 1, 2, 3, 4, which is filled with oil, the high-pressure pump 5 (discharge pressure P1), the low-pressure pump 6 (discharge pressure P3) and the common electric oil-immersed motor 7, which in this case, as an example, is a single-phase alternating current motor which needs the pressure shunting switch DW to start up. The housing furthermore has the return connection port 8, through which the return line 9 extends from the valve combination V and the directional control valve W into the housing interior.

The pump aggregate A (FIG. 4) according to the disclosure has at the housing only a single pressure outlet 13 (discharge pressure P') leading into the valve combination V. The pressure outlet 13 comprises a (FIG. 6) pressure pipe 23, that extends from a single outlet port 14 of an interior valve block 10 to the pressure outlet 13, above which the valve combination V is mounted on the exterior of the housing. The valve block 10 contains the aperture B, the check valve R, the low-pressure change-over valve U and the optional pressure shunting switch DW. The discharge outlet port of the high-pressure pump 5 is connected to the valve block 10 at 11, for example, by means of a pressure pipe 38 (discharge pressure P1 of the high-pressure pump 5), while the discharge outlet port of the low-pressure pump 6 is connected to an inlet port 12 in the valve block 10 (discharge pressure P3 of the low-pressure pump 6).

The low-pressure change-over valve U is pre-loaded by a spring 37 in the direction to a blocking position and is actuated in the opening direction via a pilot line 41 with an aperture 42 contained therein. The pressure shunting switch DW, if present, is pre-stressed by a spring 35 to open to the return line 9 and furthermore is pressure actuated in the opening and closing directions from pilot lines 31, 31' that are formed as housing channels in the valve block 10.

For an embodiment of the pump aggregate A according to the disclosure in FIG. 4, which is equipped with a three-phase oil-immersed motor 7 which does not absolutely need the pressure shunting switch DW to start up counter to pressure, the housing channels in the valve block 10 can be closed by plugs 40, or, alternatively, an even more compact valve block 10 can be used that does not contain the pressure shunting switch DW (and the aperture B) (not shown).

The housing channels in the valve block 10 in FIG. 4 (pilot line 31, a branch line across the check valve R, the pilot line 41, and a connection line 32 to the return channel across the pressure shunting switch DW) branch off from a pressure line extending in the valve block 10 from the inlet port 11 to the outlet port 14 and to the housing pressure outlet 13 through the pressure pipe 23. The low-pressure change-over valve U is contained in a working line that runs from a second inlet port 12 of the valve block 10 to the return line 9. The connection line extending across the check valve R is connected to this working line. A further pressure pipe 39 may be installed and connected to the single outlet port 14 of the valve block 10 (also refer to FIG. 6).

Figure 5:
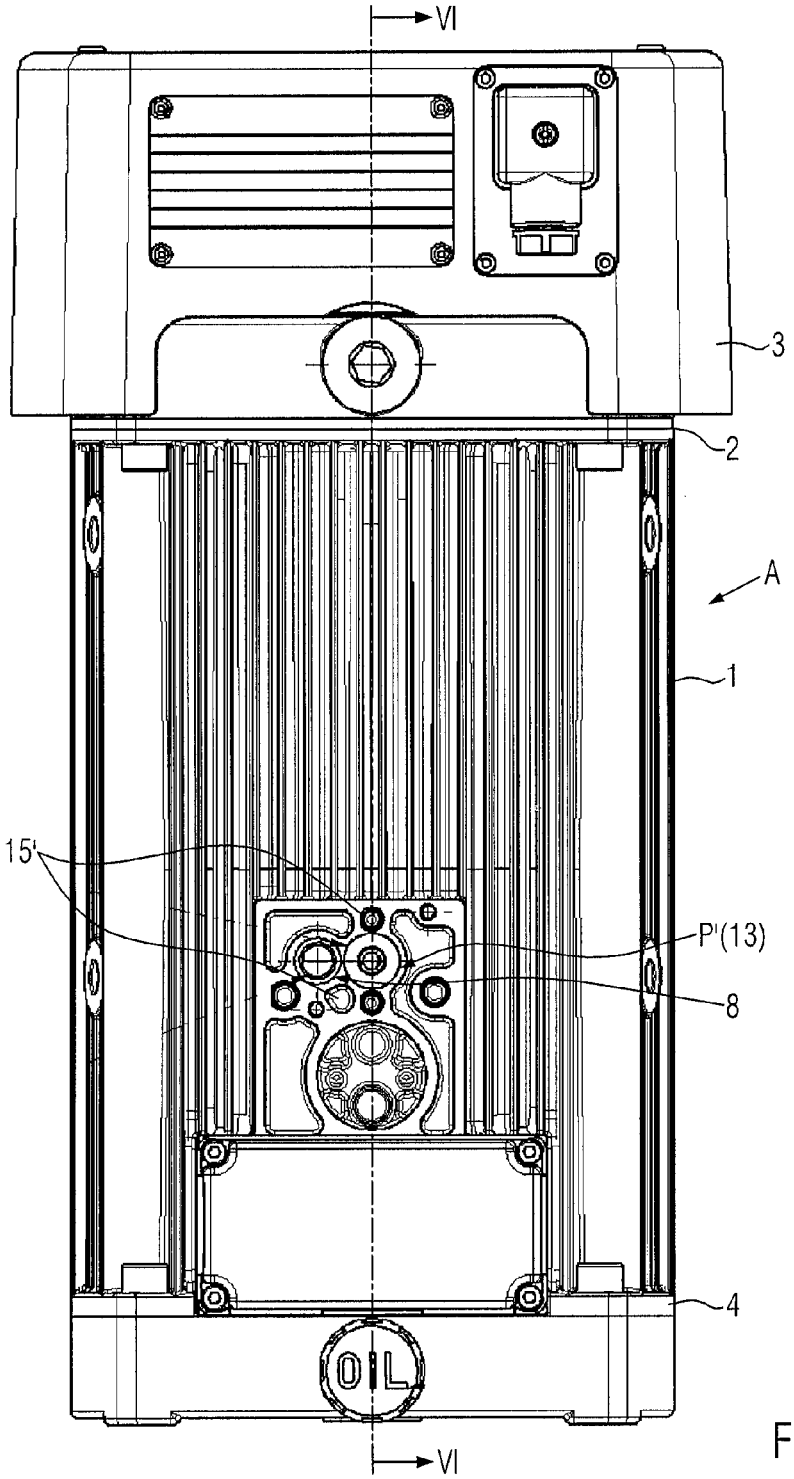
FIG. 5 is a side view of the pump aggregate according to the disclosure, whereby external equipment components are left out.

FIG. 5 shows the pump aggregate A according to the disclosure in a side-view with the valve combination V removed. Bores 15' are positioned on both sides of the single pressure outlet 13 (pressure P') for the mounting screws 15 shown in FIG. 3. In this area, the return connection point 8, for example, can also be situated in the housing exterior wall.

Figure 6:
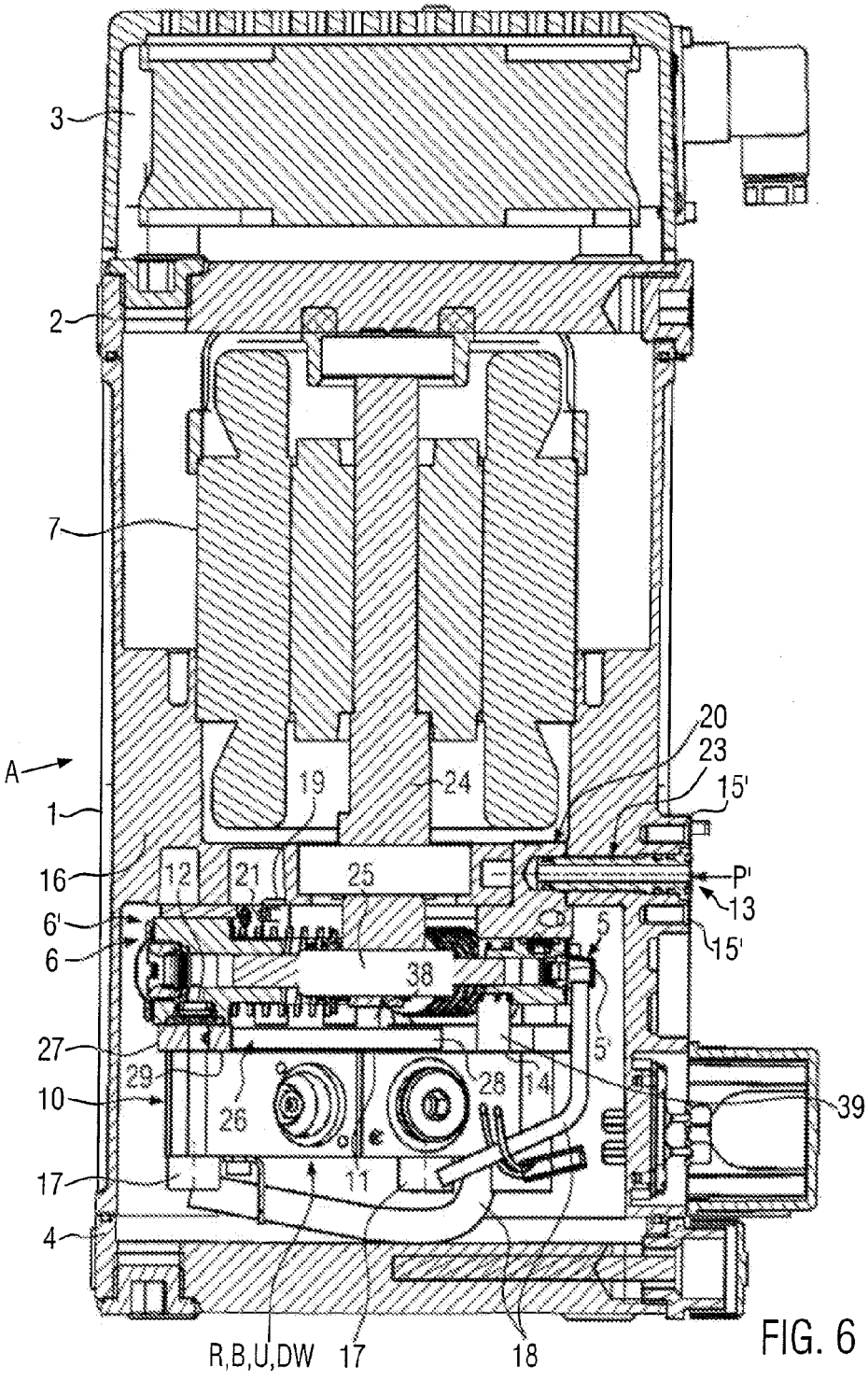
FIG. 6 is a cross-section in a plane VI-VI in FIG. 5 of the pump aggregate according to the disclosure.

The sectional representation in FIG. 6 (sectional plane VI-VI in FIG. 5) shows the interior construction of the housing 1, 2, 4, 3 in detail. The pipe section of the housing 1 has a moulded-in interior wall structure 16 that is used for the assembly of a stator of the oil-immersed motor 7, whose drive shaft 24 extends through a bearing, which is not further highlighted, in the interior wall structure 16 to a driving eccentric 25 for both the high-pressure and low-pressure pumps 5, 6.

In the shown embodiment, the high-pressure pump 5 consists, for example, of three piston pump elements 5' mounted around the drive shaft axis offset respectively by 120°. These piston pump elements 5' are mounted on a high-pressure pressure collector ring 19 and with the same on the interior wall structure 16. In the shown embodiment, the low-pressure pump 6 likewise comprises three low-pressure piston pump elements 6', that are grouped around the drive shaft axle 24 offset to one another by 120° and, for example, mounted to the housing interior wall structure 16 via spacer washers and mounting screws 17, so that high-pressure pump elements 5' and low-pressure pump elements 6' alternate at regular intervals in the circumferential direction. Mounted on the low-pressure pump elements 6' is a low-pressure pressure collector ring 26 on which the valve block 10 can be mounted directly, namely with the same mounting screws 17. FIGS. 7, 8 and 14, 15 are referenced in this regard.

An outlet pressure valve of the left-hand low-pressure pump element 6' opens through a collector plate 27 of the low-pressure pressure collector ring 26 to the second inlet port 12 of the valve block 10 (opening 29). The three collector plates 27 of the low-pressure pressure collector ring 26 are connected to one another via pipe sections 28, so that all three low-pressure pump elements 6' commonly supply the second inlet port 12.

Figure 14:
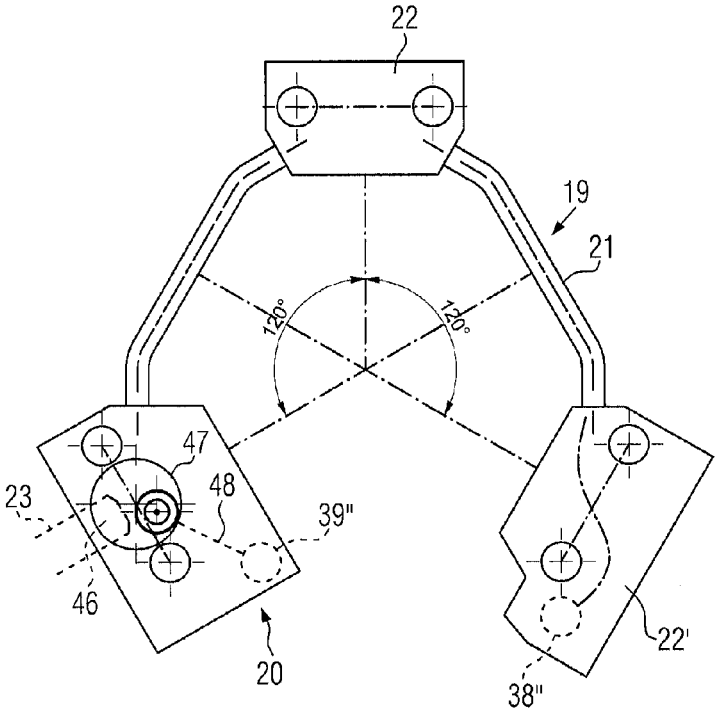
FIG. 14 is a schematic top-view of a high-pressure pressure collector ring, which is indicated in the mounted state in FIGS. 6, 7 and 8.
Figure 15:
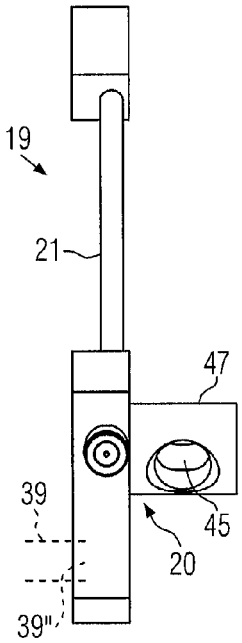
FIG. 15 is a side view of the high-pressure pressure collector ring of FIG. 14 in a view from the left in FIG. 14.

In FIG. 6, a body 20 of the high-pressure collector ring 19 explained by means of FIGS. 14 and 15 is connected to two further bodies 22, 22' (FIG. 14) of the high-pressure collector ring via pipe sections 21. A pressure pipe 39 connects the single outlet port 14 of the valve block 10 to the body 20. A further pressure pipe 38 (pressure P1) connects the inlet port 11 of the valve block 10 to another body 22' (FIG. 14) of the high-pressure pressure collector ring 19. The valve block 10 contains the check valve R, the aperture B, the low-pressure change-over valve U and the optionally required pressure shunting switch DW in an extremely compact arrangement and correspondingly interconnected via housing channels, which are indicated in FIG. 4, in the valve block 10. At least some of the high-pressure and/or low-pressure pump elements 5', 6' are connected via suction hoses 18 to a low-lying oil sump (return line 9) (depending on the operating position of the pump; assembly A; upright or recumbent). The body 20 of the high-pressure pressure collector ring 19, which is connected to the single outlet port 14 of the valve block 10 via the pressure pipe 39, connects this flow path to the single pressure outlet 13 of the housing via the pressure pipe 23 inserted in a bore of the housing interior wall structure 16 (discharge pressure P').

Figure 7:
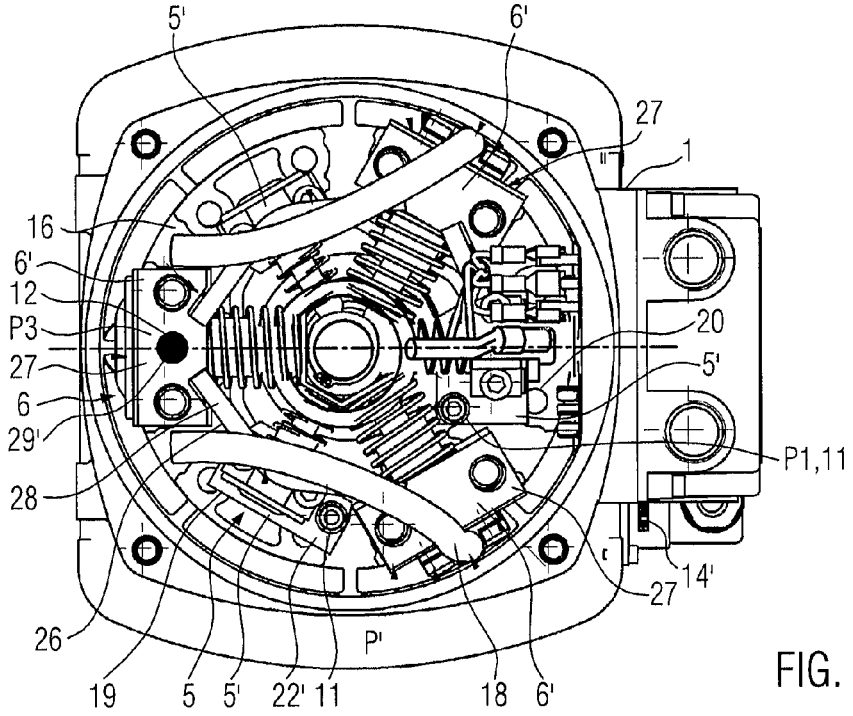
FIG. 7 is an assembly stage of the pump aggregate according to the disclosure with the lower housing cover removed, in a view from below.

FIG. 7 illustrates an assembly stage of the pump aggregate A in which first the high-pressure pump elements 5' and the low-pressure pump elements 6', as well as the suction hoses 18, the (not to be seen in FIG. 7) high-pressure pressure collector ring 19 and the low-pressure pressure collector ring 26 with the pipe sections 28 and the collector plates 27 on the low-pressure pump elements 6' are affixed to the housing interior wall structure 16. Lying free in the body 22' of the high-pressure pressure collector ring 19 is a connection port that is aligned with the inlet port 11 of the valve block 10 (FIG. 6), while an inlet 14' lies free in the body 20 of the high-pressure pressure collector ring 19 under another high-pressure pump element 5', whereby this inlet 14' will become aligned with the single outlet port 14 of the valve block 10 that is to be mounted. Finally, in a collector plate 27 arranged on a low-pressure pump element 6' (in FIG. 7 at the left) an opening 29' lies free (discharge pressure P3 of the low-pressure pump 6), that will become aligned with the second inlet port 12 of the valve block 10 to be mounted. At 14' and 11, the pressure pipes 39, 38 indicated in FIG. 6 are mounted during or after the assembly stage shown in FIG. 7.

Figure 8:
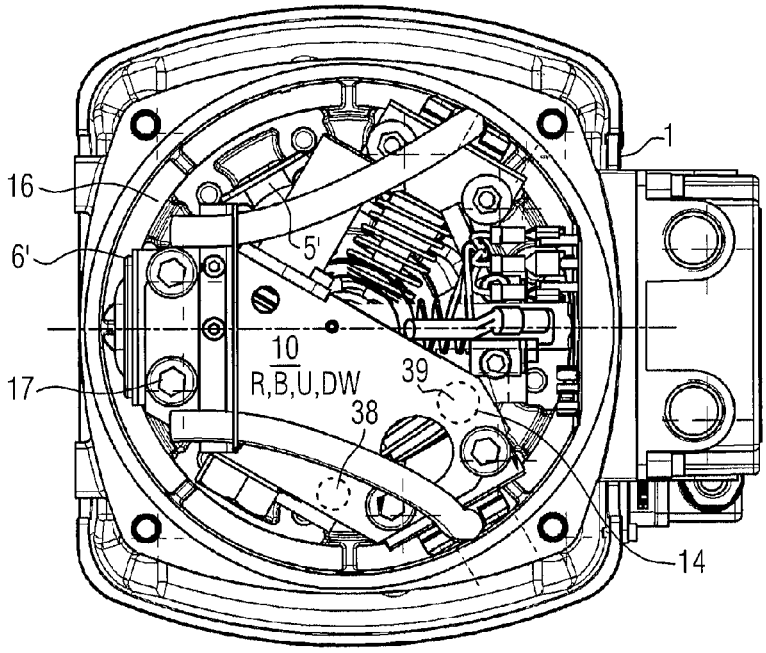
FIG. 8 is a further assembly stage with the lower housing cover removed, from below in FIG. 6.

In FIG. 8, the valve block 10 is assembled underneath the suction hoses 18 and fixed by the same mounting screws 17 that also fix two of the low-pressure pump elements 6' on the housing interior wall structure 16. The pressure pipes 38, 39 (indicated in dashed lines) are pressure-tight connections between the valve block 10 and the bodies 22', 20 of the high-pressure pressure collector ring 19.

FIG. 9 is a side-view of the valve block 10, which has an approximately trapezoidal profile, and which is, according to FIG. 8, nestled into the round interior cross-section of the housing. FIG. 9 shows the single outlet port 14 (pressure P') into which the pressure pipe 39 is introduced in the valve block exterior side, the inlet port 11 into which the pressure pipe 38 is introduced (pressure P1) and the area 12 with the opening 29 leading to the check valve R. FIG. 9 furthermore illustrates the grouping of the aperture B, the pressure shunting switch DW, the low-pressure change-over valve U and the check valve R in the valve block 10.

The accompanying sectional representation in FIG. 10 (sectional plane X-X in FIG. 9) shows an aperture insert 30 in a block bore, to which the inlet port 11 is connected, from which, upstream of the aperture insert 30, the control line 31 branches to the closing control side of the pressure shunting switch DW, and from which downstream of the aperture insert 30 the connection line 32 branches, whereby this connection line 32 runs across the pressure shunting switch DW to the return channel 9. Some of the block bores are closed by plug screws in FIG. 10.

In a sectional view (sectional plane XI-XI in FIG. 9), FIG. 11 shows the pressure shunting switch DW that contains, in a block bore, a seat valve cone 33, which co-acts with a valve seat 34 of a sleeve insert and which is acted upon in the opening direction by the spring 35. The control line 31 is connected to the closing control side situated at the larger end diameter of the seat valve cone 33, while the control line 31' branches off from the connection line 32 and runs to the opening control side situated in the area of the spring 35 of the seat valve cone 33.

In a sectional view (sectional plane XII-XII in FIG. 9), FIG. 12 shows the low-pressure change-over valve U with a valve slider 36 in a block bore of the valve block 10. In the shown blocking position, the valve slider 36 is acted upon by the spring 37 while separating a housing channel 43 from the return line 9. In the opening control direction of the valve slider 36 (FIG. 12 to the top), the valve slider 36 is pressure actuated via the aperture (or nozzle) 42 from the control channel 41, which branches off of the connection line 32 coming from the aperture B.

In a sectional view (sectional plane XIII-XIII in FIG. 9), FIG. 13 shows the check valve R with a screw-in insert, which forms a seat 44, and a mushroom-shaped valve element 45 that separates, in a block bore, the connection line 32 from the channel 43 that leads to the low-pressure change-over valve U. The block bore has the opening 29 (pressure P3) that is aligned with the opening 29' that is shown in FIG. 7.

FIG. 14 illustrates schematically the high-pressure pressure collector ring 19 with the three bodies 20, 22 and 22', which are connected to one another via the pipe sections 21. On one side, the body 20 has a connection protrusion 47 in which is formed a bore 46 for pressing-in the pressure pipe 23. The pressure pipe 23 is connected via a channel 48 to a connection point 39' in which the pressure pipe 39 sits. The body 22' of the high-pressure pressure collector ring 19 has a connection point 38" in which the pressure pipe 38 sits and that communicates with the pipe section 21.

Function of the pump aggregate A of FIGS. 3 to 15:

After the oil-immersed motor 7 has been switched on, both pumps 5, 6 discharge, whereby their discharge flows are combined in the blocking position, shown in FIG. 4, of the low-pressure change-over valve U via the check valve R and first flow, via the pressure shunting switch DW which is in the through flow position, into the return line 9, so that the oil-immersed motor 7 in the case of a single-phase alternating current motor is able to start up easily without counter-pressure on the pumps 5, 6. As soon as the oil-immersed motor 7 has started up and a sufficient pressure drop develops at the aperture B, the pressure shunting switch DW is brought into the blocking position by pressure from the control line 31, so that if the check valve R is open hydraulic medium (pressure P') is available at the single pressure outlet 13 of the housing. As soon as, via the aperture 42 and the control line 41, a sufficiently high pressure, defined by the spring 37, is present, the low-pressure change-over valve U is controlled to open, so that the discharge flow (feed pressure P3) of the low-pressure pump 6 is supplied into the return line 9 counter to low flow resistance 9 only. From then on only the high-pressure pump 5, while the check valve R is held closed, discharges to the single pressure outlet 13 (pressure P'), until finally, the desired maximum pressure (limited by the system pressure-limiting valve DB) of, for example, 700 bar is reached, which is processed at the pressure connection port P by the directional control valve W. For example, at the consumer connection port A' the secondary pressure is limited to 100 bar by the secondary pressure-limiting valve SD.

The summed discharge flows of the two pumps 5, 6 are, for example, used to execute an idle stroke quickly e.g., in a portable tool assembly, while the discharge flow of only the high-pressure pump 5 is used for building up the required high maximum pressure of, for example, about 700 bar in the tool assembly after the idle stroke has been run through.

If the oil-immersed motor 7 is a three-phase motor that is capable of starting up against pressure on the pumps, the pressure shunting switch DW can be dispensed with or may be passivated.

If the oil-immersed motor 7 is switched off and if the pressure in the pressure line running to the pressure outlet 13 drops correspondingly, e.g., due to consumption, the low-pressure change-over valve U switches back to the shown blocking position again and the pressure shunting switch DW returns to its shown through flow position, so that the pressure in the system is relieved through the return line.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A pump aggregate for supplying at least one directional control valve, the pump aggregate comprising:

a housing including an interior wall structure;

a high-pressure pump disposed in the housing and having a discharge outlet port;

a low-pressure pump disposed in the housing and having a discharge outlet port separated from the outlet port of the high-pressure pump;

an oil-immersed electric motor for both pumps;

a return connection point connected to a return line; and a valve combination mounted between the separated discharge outlet ports of the pumps and a pressure connection point, the valve combination comprising at least one low-pressure change-over valve that can be switched open depending on pressure to the return line, a check valve for combining discharge flows of the pumps until the at least one low-pressure change-over valve is switched open, and a system pressure-limiting valve, wherein at least the at least one low-pressure change-over valve and the check valve are arranged in an interior of the housing and are connected in such a way that the discharge flows of both pumps are combinable in the housing interior into a single pressure outlet of the housing, and wherein at least the system pressure-limiting valve is connected to the pressure outlet and is mounted on an exterior of the housing;

wherein the pumps include pump elements installed on the interior wall structure of the housing, and wherein the at least one low-pressure change-over valve and the check valve are arranged in a common valve block, which is mounted in the interior of the housing on the pump elements.

2. The pump aggregate according to claim 1 wherein the motor is an alternating current motor for commonly driving both pumps, and the valve combination comprises a pressure shunting switch connected to the return line and an aperture assigned to the pressure shunting switch, and wherein the pressure shunting switch and the aperture are arranged in the interior of the housing.

3. The pump aggregate according to claim 2 wherein the aperture, the check valve, the at least one low-pressure change-over valve, and the pressure shunting switch each have valve inserts inserted into bores of the valve block, the bores being connected via channels formed in the interior of the valve block.

4. The pump aggregate of claim 2 wherein the pressure shunting switch and the aperture are arranged in the common valve block.

5. The pump aggregate according to claim 1 wherein the valve block has a single outlet port that is connected through the housing interior wall structure to the pressure outlet of the housing.

6. The pump aggregate according to claim 1 wherein the valve block has an approximately trapezoidal profile that can be nestled in an approximately circular interior cross-section of the housing.

7. The pump aggregate according to claim 1 wherein the motor has a drive shaft, and each pump includes a plurality of the pump elements that are installed around the drive shaft in essentially the same radial plane of the housing on the housing interior wall structure such that the pump elements of the high-pressure pump alternate with the pump elements of the low-pressure pump in a circumferential direction, and wherein the pump aggregate further comprises a high-pressure pressure collector ring connected to the pump elements of the high-pressure pump, and a low-pressure pressure collector ring connected to the pump elements of the low-pressure pump.

8. The pump aggregate of claim 7 wherein each pump includes at least three of the pump elements, the low-pressure pressure collector ring includes collector plates, and the valve block is mounted on the collector plates.

9. The pump aggregate according to claim 7 wherein the high-pressure collector ring includes a body comprising a connection protrusion and mounted underneath one of the high-pressure pump elements, and wherein the valve block has an outlet port connected to the pressure outlet of the housing through the body.

10. The pump aggregate according to claim 9 wherein the outlet port of the valve block is connected to the pressure outlet of the housing via a pressure pipe press-fit into the connection protrusion of the body and into a bore of the housing interior wall structure.

11. The pump aggregate according to claim 1 further comprising suction hoses connected to at least some of the pump elements, and wherein, depending on a position of the pump aggregate, the suction hoses are configured to extend to a low-lying oil sump in the housing.

12. The pump aggregate according to claim 1 wherein the housing comprises an externally ribbed pipe section having a moulded-in housing interior wall structure for fixing in place the oil-immersed motor and the pumps, and wherein the housing further comprises housing covers affixed at ends of the pipe section.

13. The pump aggregate according to claim 12 further comprising a cooling fan supported on one of the housing covers.

14. The pump aggregate according to claim 1 wherein parts of the valve combination arranged on the exterior of the housing are mounted on the exterior of the housing above the single pressure outlet of the housing.

15. The pump aggregate of claim 1 wherein the pump aggregate includes the at least one directional control valve, and wherein the system pressure-limiting valve and the at least one directional control valve are mounted on the exterior of the housing above the pressure outlet of the housing.

16. The pump aggregate according to claim 9 wherein the valve block has a connection point that is connected to an opening of the high-pressure pressure collector ring by an inserted pressure pipe, the outlet port of the valve block is connected to an opening of the body of the high-pressure pressure collector ring by an inserted pressure pipe, and the valve block has an valve block opening to the check valve and is mounted with the valve block opening in a sealed manner directly above an outlet of the low-pressure pressure collector ring.

17. A pump aggregate for supplying at least one directional control valve, the pump aggregate comprising:

a housing having an interior wall structure and a pressure outlet;

a high-pressure pump disposed in the housing and having a discharge outlet port;

a low-pressure pump disposed in the housing and having a discharge outlet port separated from the outlet port of the high-pressure pump;

a motor for operating the pumps; and a valve combination associated with the housing, the valve combination comprising a return line, a low-pressure change-over valve that can be switched open depending on pressure to the return line, a check valve for combining discharge flows of the pumps until the low-pressure change-over valve is switched open, and a system pressure-limiting valve, wherein at least the low-pressure change-over valve and the check valve are arranged in an interior of the housing and are connected in such a way that the discharge flows of both pumps are combinable in the housing interior into the pressure outlet of the housing, and wherein the system pressure-limiting valve is connected to the pressure outlet and is mounted on an exterior of the housing;

wherein the pumps include pump elements installed on the interior wall structure, and wherein at least the low-pressure change-over valve and the check valve are arranged in a common valve block, which is mounted in the housing interior on the pump elements.

18. The pump aggregate of claim 17 wherein the motor is an alternating current motor for commonly driving both pumps.

19. The pump aggregate of claim 17 wherein the valve combination comprises a pressure shunting switch connected to the return line, and wherein the pressure shunting switch is arranged in the interior of the housing.

20. The pump aggregate of claim 19 wherein the pressure shunting switch is arranged in the common valve block.

* * * * *